United States Patent [19]

Warner

[11] Patent Number: 4,835,825

[45] Date of Patent: Jun. 6, 1989

[54] MACHINE FOR MANUFACTURING A ROOF VENT HAVING A LEAD BASE

[76] Inventor: Kenneth M. Warner, P.O. Box 152, Southworth, Wash. 98386

[21] Appl. No.: 179,959

[22] Filed: Apr. 7, 1988

[51] Int. Cl.[4] ..... B23D 23/04

[52] U.S. Cl. ..... 29/33 K; 29/512; 29/523; 29/243.52; 52/199; 98/42.22

[58] Field of Search ..... 52/199; 29/512, 523, 29/243.52, 33 K; 98/42.07, 42.21, 42.22

[56] References Cited

U.S. PATENT DOCUMENTS

| | | | |
|---|---|---|---|
| 1,679,676 | 8/1928 | Miele | 29/243.52 |
| 2,403,998 | 7/1946 | Pottle | 29/243.52 |
| 3,289,287 | 12/1966 | Guritz | 29/512 X |
| 3,571,891 | 3/1971 | Roberts | 29/243.52 X |
| 3,981,068 | 9/1976 | Saxon | 29/523 |
| 4,010,533 | 3/1977 | Pitner | 29/523 |
| 4,187,597 | 2/1980 | Bremer, Jr. | 29/243.52 X |
| 4,334,703 | 6/1982 | Arthur et al. | 29/523 X |
| 4,650,532 | 3/1987 | Kloehn et al. | 29/512 X |
| 4,711,012 | 12/1987 | Walters et al. | 29/243.52 |

*Primary Examiner*—Charlie T. Moon

*Attorney, Agent, or Firm*—Roy E. Mattern, Jr.

[57] ABSTRACT

A modified metal roof vent, selected from several available types, however, not having a base, but having a cylindrical body, having in turn an open top end and an open bottom end, an inside entry circular recess structure, positioned above this open bottom, and a weather cover secured at a spaced distance above the open top end, is fitted with a lead base, which has portions of this lead base inserted upwardly inside the cylindrical body and then moved radially outwardly to complementary fit the inside entry circular recess structure of the modified metal roof vent, completing the roof vent having a lead base, and a machine for manufacturing this vent, and methods for making this vent, and optionally including a weather sealant material placed between the cylindrical body and the complementary formed portions of the lead base at the locale of the inside entry circular recess structure of this vent.

6 Claims, 4 Drawing Sheets

FIG. 1
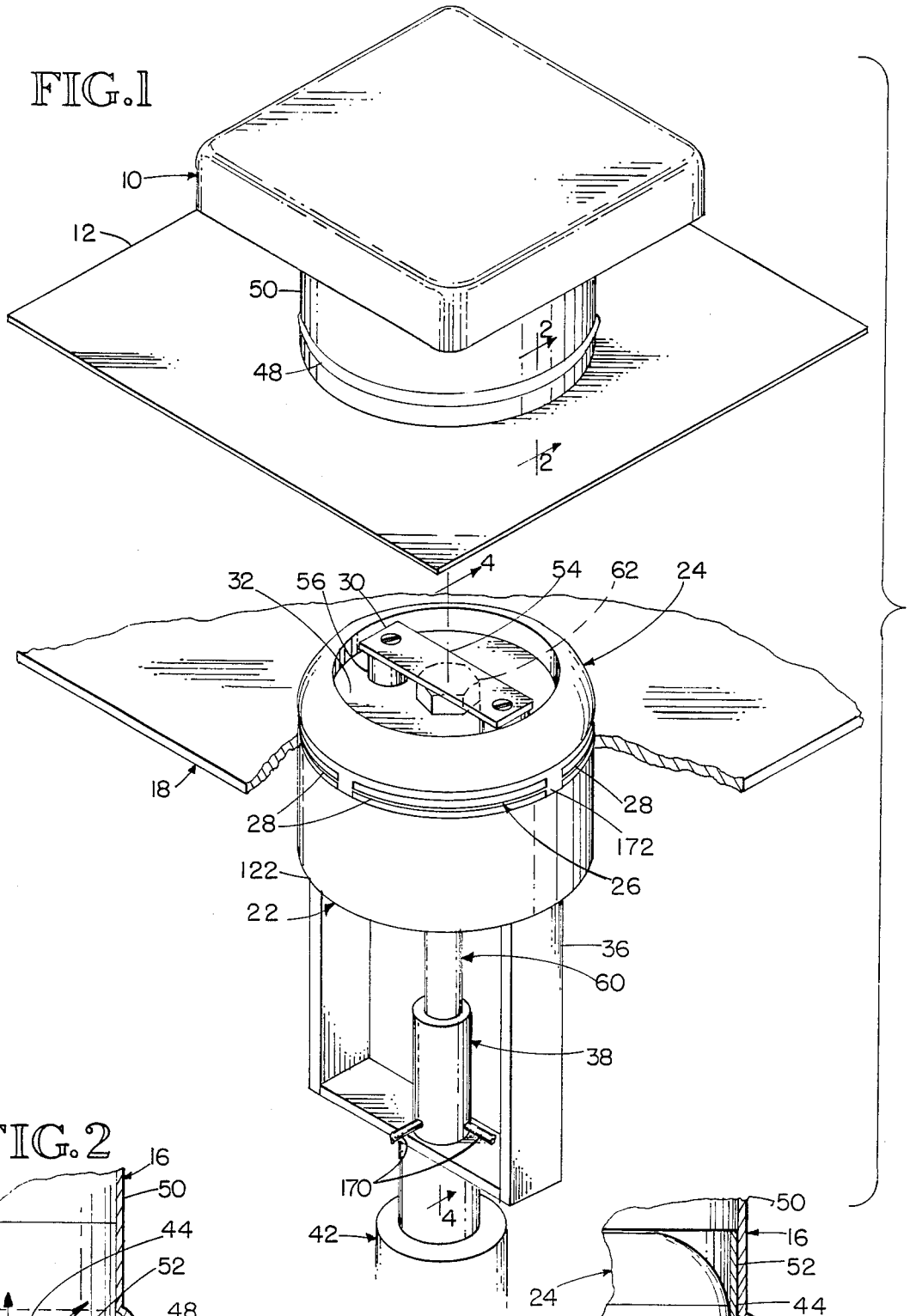
FIG. 2
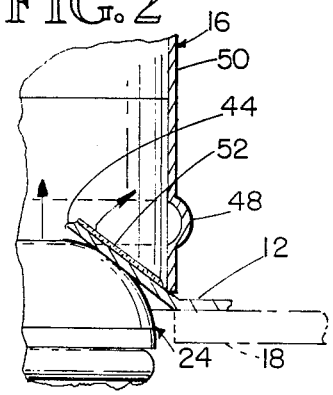
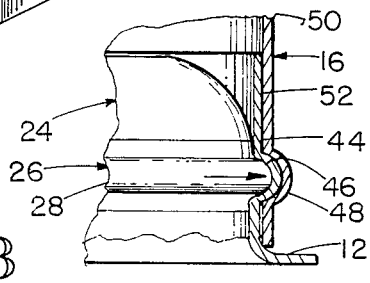
FIG. 3

MACHINE FOR MANUFACTURING A ROOF VENT HAVING A LEAD BASE

BACKGROUND

When tile roofs are installed on buildings they are expected to last a very long time. Therefore lead bases of roof vents are preferably specified and installed, so the roof vents will also last a very long time. Such lead base roof vents previously and currently being installed use an interior clamping ring to hold portions of the lead base adjacent to interior portions of the cylindrical body of the roof vent. These clamped together roof vents are not as structurally sound as the builders and owners of dwellings would like them to be. Also, oftentimes, these roof vents are not as weatherproof as these builders and owners of dwellings would like them to be. Therefore, there remained a need for a better roof vent having a lead base, which is secured in a sound structural interfit, and which is also weatherproof thereby making the roof vent with a lead base, a very reliable one during the entire long term of the particular tile roof.

SUMMARY

When tile roofs are installed on buildings, the roof vents having a lead base which are structurally secured together by using their complementary respective inside entry circular recess structures, insure the life of these vents will substantially match the life of these tile roofs. Moreover, when long lasting sealant material is applied during their manufacture, excellent weatherproofing also extends for a very long time. These roof vents having such complementary fitting inside entry circular recess structures, of both the cylindrical body of a modified metal roof vent, and the upturned and radially outwardly moved lead portions of a lead base, are efficiently and conveniently manufactured using machines and methods which insure the long lasting quality of these roof vents with a lead base.

DESCRIPTION OF THE DRAWINGS

The preferred embodiment of the roof vent with the lead base for installation primarily on roofs of dwellings, which are covered with tiles, with the expectations of the overall roof lasting a very long time, is illustrated in the drawings, along with the preferred embodiment of the machine for manufacturing them, wherein:

FIG. 1 is a perspective view of the roof vent with the lead base which has just been completed and lifted clear of a hollow crown edge forming dome die of a subassembly of the lead forming assembly of a machine used in making this roof vent;

FIG. 2 is a partial side elevation, with portions removed, to illustrate how the commencing upward movement of the hollow crown edge forming dome die is starting to move portions covered with a sealant of the lead base up and eventually against the interior of the cylindrical body of the modified metal roof vent in the locale of the inside entry circular recess structure thereof;

FIG. 3 is a partial side elevation, with portions removed, similar to FIG. 2, to illustrate how the completed outward radial movements of the radial movable segmented dies have completed the formation of the inside entry circular recess of the lead base with sealant to complementary fit the inside entry circular recess of the cylindrical body of the modified metal roof vent, thereby completing this roof vent with a lead base;

DESCRIPTION OF PREFERRED EMBODIMENTS

Figure 4:
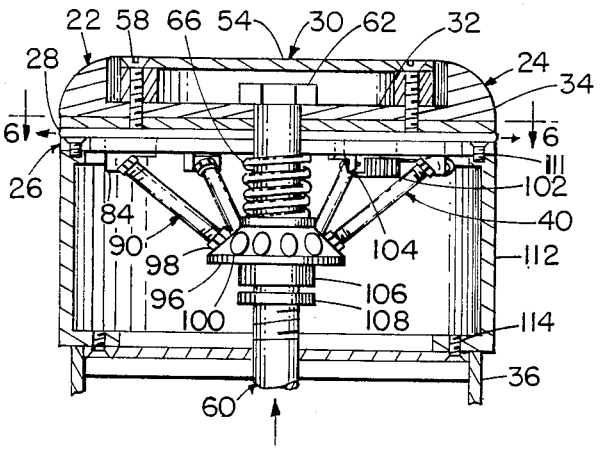
FIG. 4 is a partial side elevation, with portions removed, to illustrate the construction of the interior of the hollow crown edge forming dome die, and the arrangement of the radial expanding forming die subassembly secured and operated within this hollow crown edge forming dome die, indicating the position of the radially movable die segments and their linkage subassembly, before they are moved radially outwardly.
Figure 4:
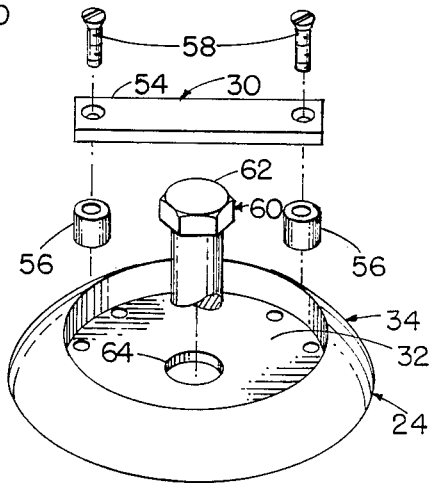

Preferred embodiments of a roof vent 10 with a lead base 12 and a machine 14 used in manufacturing this roof vent 10 with the lead base 12 are illustrated in the drawings, to show how a modified metal roof vent 16 having a lead base 12, when completed, is ready for installation, and to show how a machine 14 is operated to manufacture this roof vent with the lead base 12.

HOW THE ROOF VENT WITH A LEAD BASE IS FORMED

In FIG. 1, the roof vent 10 with the lead base 12 is illustrated after having been raised above about the elongated surface structure 18 of the bench height structure 20 of the machine 14. A lead forming assembly 22 is in the raised position, with a hollow crown edge forming dome die 24 thereof projecting above the elongated surface structure 18. A radial expanding forming die subassembly 26 has the radially movable die segments 28 thereof retracted. A stroke adjustment subassembly 30 is shown mounted on a guiding central hole structure 32 of a crown edge structural ring 34 of the hollow crown edge forming dome die 24.

Depending below this hollow crown edge forming dome die 24, are more components of the lead forming assembly 22, as shown in FIG. 1, indicating the upper frame 36, the second lifting mechanism 38 secured to the upper frame 30, which via a linkage subassembly 40, shown later in FIG. 4, creates the radial forces moving the radially movable die segments 28 of the radial expanding forming die subassembly 26. The first lifting mechanism 42, which is secured to the bottom of the upper frame 36, is shown in its raised position in FIG. 1.

When this first lifting mechanism 42 is operated, the upper frame 36, which supports the hollow crown edge forming dome die 24, moves upwardly, driving this dome die 24 against the circular lead portions 44 of the lead base 12, pushing and pivoting them upwardly, as indicated by the motion arrows in FIG. 2.

Subsequently, when the second lifting mechanism 38 is operated, the radial expanding forming die subassembly 26 actively moves the radially movable die segments 28 radially outwardly, as shown in FIG. 3. An inside entry circular recess structure 46 of the circular lead portions 44 of the lead base 12 is thereby formed. This recess structure 46 complementary fits an inside entry circular recess structrue 48 of the cylindrical body 50 of the modified metal roof vent 16, i.e. the roof vent 10 with the lead base 12.

Preferably a sealant material, i.e. a sealant 52, is prepositioned and distributed around the circular lead portions 44 of the lead base 12 before they are so formed, as shown in FIG. 2, resulting in the distribution of the sealant 52 between the inside entry circular recess structure 46 of the lead base 12 and the complementary inside entry circular recess structure 48 of the roof vent 10 with lead base 12, as shown in FIG. 3.

HOW THE LEAD FORMING ASSEMBLY IS CONSTRUCTED AND OPERATED

In FIG. 4, the interior of the hollow crown edge forming dome die 24 is illustrated, indicating the assembly and positioning of the radial expanding forming die subassembly 26, with respect to crown edge structural ring 34, the stroke adjustment subassembly 30, and the upper frame 36. The exploded view of these subassemblies and parts is presented in FIG. 5. The stroke adjustment subassembly 30 has a cross abutment bar 54 positioned on interchangeable and selectable height cylindrical spacers 56, and secured with fasteners 58 to the guiding central hole structure 32 of the crown edge structural ring 34.

The centered upright shaft 60, having a bolt-like head 62 is part of the linkage subassembly 40 of the radial expanding forming die subassembly 26. This shaft 6 moves up and down through the center hole 64 of the guiding central hole structure 32 of the crown edge structural ring 34 of the hollow crown edge forming dome die 24.

When the second lifting mechanism 38 is actuated, the shaft 60 is moved up to contact the cross abutment bar 54 of the stroke adjustment subassembly 30. During this upward movement of the shaft 60, the linkage subassembly 40 is moved, creating the overall movement of the radial expanding forming die subassembly 26, causing the radially movable die segments 28 to move outwardly to form the inside entry recess 46 of the lead base 12.

Following this recess forming operation, the second lifting mechanism 38 is released, and the expanding operation of the compressed large coiled spring 66, slidably positioned about the shaft 60, effectively lowers the shaft 60. As the shaft 60 is lowered, the linkage subassembly 40 is oppositely moved, in turn creating the overall retractive movement of the radial expanding forming die subassembly 26, thereby causing the radially movable die segments 28 to withdraw from the inside entry recess 46 of the lead base 12. This recess 46 had just been formed to complementary fit the inside entry circular recess 48 of the cylindrical body 50 to complete the roof vent 10 with the lead base 12.

Figure 5:
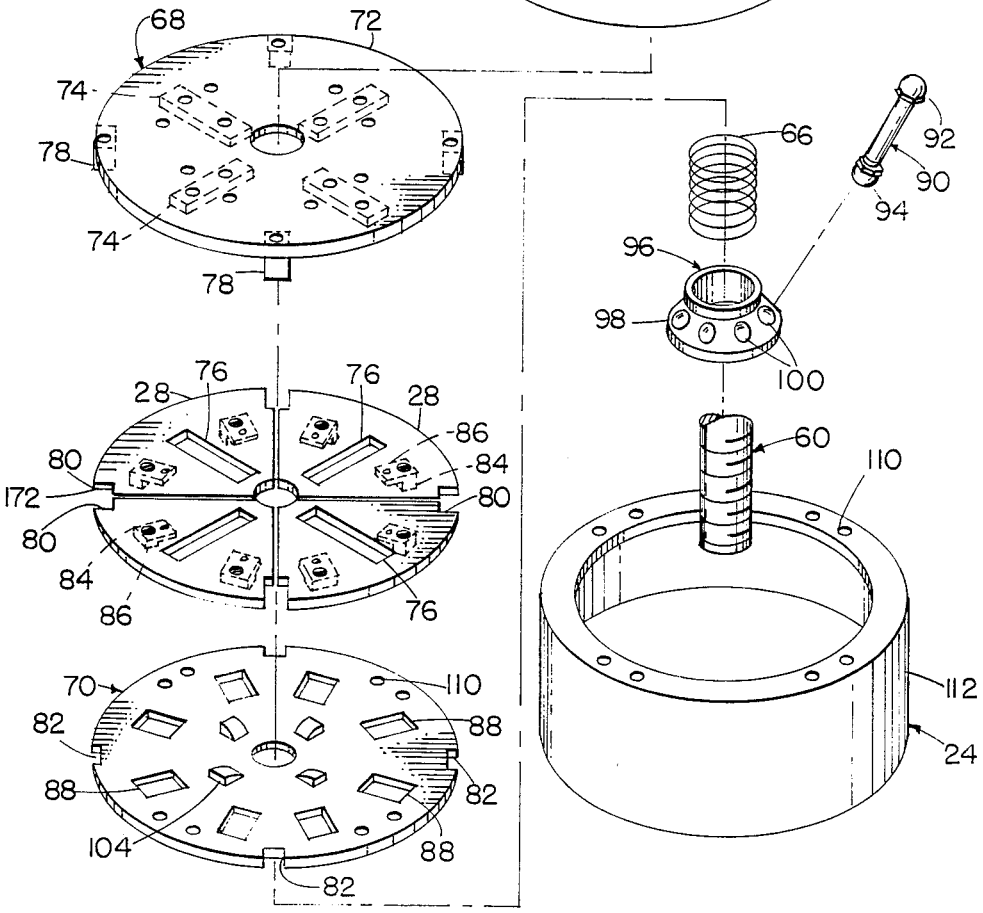
FIG. 5 is an exploded perspective view of many of the components which are shown as assembled in FIG. 4, inclusive of a stroke adjustment subassembly at the top of this view, the crown edge structural ring of the hollow crown edge forming dome die, an upper circular guide plate, radially movable die segments, a lower circular guide plate, a coiled spring, one of several push rods, a non threaded hub, a centered upright shaft, and a cylindrical body of the hollow crown edge forming dome die.
Figure 6:
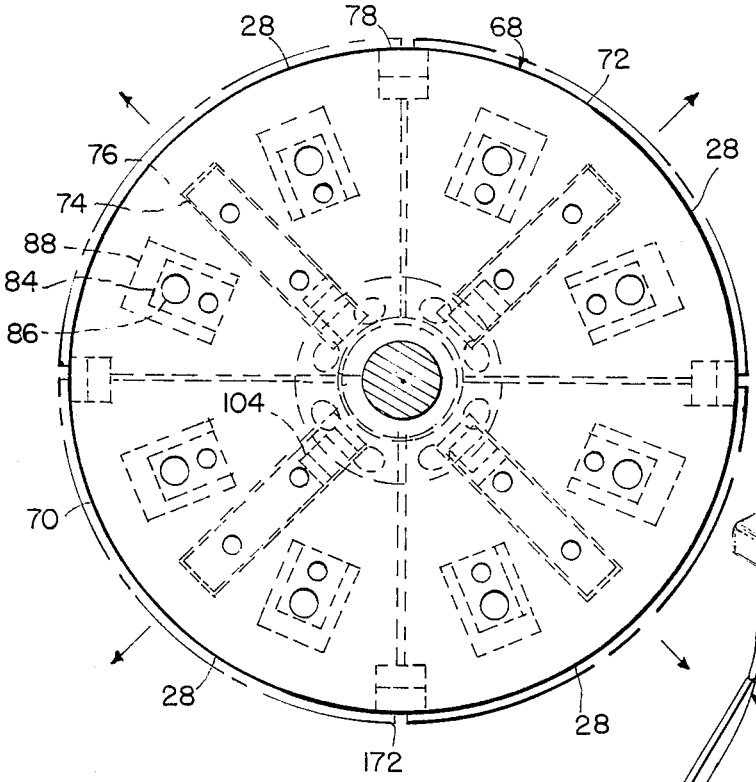
FIG. 6 is a top view of the subassembly of the upper circular guide plate subassembly, the radially movable die segments, and the lower circular guide plate, as they are assembled about the centered upright shaft, indicating the operational clearances required as the radially movable die segments are moved inwardly and then are ready to be moved outwardly to form the inside entry circular recess structure of the lead to complementary fit the inside entry circular recess structure of the cylindrical body of the modified metal roof vent to thereby create the lead base metal roof vent.

In reference to FIGS. 4, 5, and 6, and especially in reference to FIG. 5, the linkage subassembly 40 of the radial expanding forming die subassembly 26, has, in addition to the centered upright shaft 60, the axial close arrangement of an upper circular guide plate subassembly 68, the four radially movable die segments 28, and the lower circular guide plate 70. The radial movements of the four radially movable die segments are slidably guided from above by the upper guide plate 72 of the upper circular guide plate subassembly 68. Such guidance is further provided, as depending guide bars 74, secured by fasteners, not shown, to the upper guide plate 72, remain confined within each longer guide slot 76 of each radially movable die segment 28. Depending circumferential spacers 78, secured to the upper circular guide plate 72 by fasteners not shown, keep the upper circular guide plate 72, the radially movable die segments 28, and the lower circular guide plate 70 in both radial and axial alignment with each other. The radially movable die segments 28 have the partial slots 80 to provide clearance for these depending circumferential spacers 78. The lower circular guide plate 70 has slots 82 to provide clearance for these depending circumferential spacers 78.

Push rod receiving socket bars 84, each having half spherical receiving holes 86, are secured, by fasteners not shown, to the underside of the radially movable die segments 28, as shown in FIG. 5. Radial slots 88 spaced around the lower circular guide plate 70 provide the clearance for these push rod receiving socker bars 84, and the push rod subassemblies 20, as shown in FIGS. 4 and 5.

Each push rod subassembly 90, has, in effect, a half spherical headed threaded bolt 92, and a half spherical form nut 94, so the overall length is adjustable. They are arranged on a bias, which changes, as shown in FIG. 4, extending between the push rod receiving socket bars 84 and the non threaded hub 96. This hub 96 has an integral surrounding upwardly facing downwardly sloping surface structure 98, in turn having spaced half spherical receiving holes 100. The half spherical related structures accommodate the changing bias positions of the push rod subassemblies 90, during the operations of the linkage subassembly 40 of the operating radial expanding forming die subassembly 26.

After the second lifting mechanism 38 is made inactive and the large coiled spring 66 retracts the non threaded hub 96 of linkage subassembly 40, the radial retraction or bias change of the push rod subassemblies 90 is caused by the retraction of the small coiled springs 102 shown in FIGS. 4, 5, and 6. These small coiled springs 102 are connected between depending spring anchors 104, secured to the bottom of the lower circular guide plate 70, and the push rod receiving socket bars 84, depending from the radially movable die segments 28.

During the assembly of the linkage subassembly 40 of the radial expanding forming die subassembly 26, the lowest position of the non threaded hub 96 on the centered upright shaft 60, once determined, is maintained by moving the positioning threaded nut 106 about the centered upright shaft 60 to this determined lower position. Thereafter, the lock nut 108 is moved about the centered upright shaft 60 contacting the threaded nut 106 to insure the lowest position of the non threaded hub 96 is maintained. The highest position of centered upright shaft 60 is maintained by the adjustable height stroke adjustment subassembly 30. These adjustments, coupled with the adjustments of the overall lengths of the push rod subassemblies 90, insure the overall correct positioning and operation of the radial expanding forming die subassembly 26.

Fasteners, 111, via holes 110, hold the lower circular guide plate 70 to the top of the cylindrical housing 112, which surrounds the radial expanding forming die subassembly 26, and is part of the hollow crown edge forming dome die 24. This cylindrical housing 112 is secured to the upper frame 36 by fasteners 114.

Fasteners 58, and shorter ones, not shown, hold the upper circular guide plate 72 to the crown edge structural ring 34.

In FIG. 6, the view looking down on the upper circular guide plate 70, radially movable die segments 28, and the lower circular guide plate 70, the necessary clearances are indicated to accommodate the various movements of the linkage assembly 40 of the radial expanding forming die subassembly 16, involving the radial movements of the radially movable die segments 28.

HOW THE LEAD FORMING ASSEMBLY IS COMBINED WITH OTHER COMPONENTS AS A MACHINE FOR PRODUCING ROOF VENTS WITH A LEAD BASE

Figure 7:
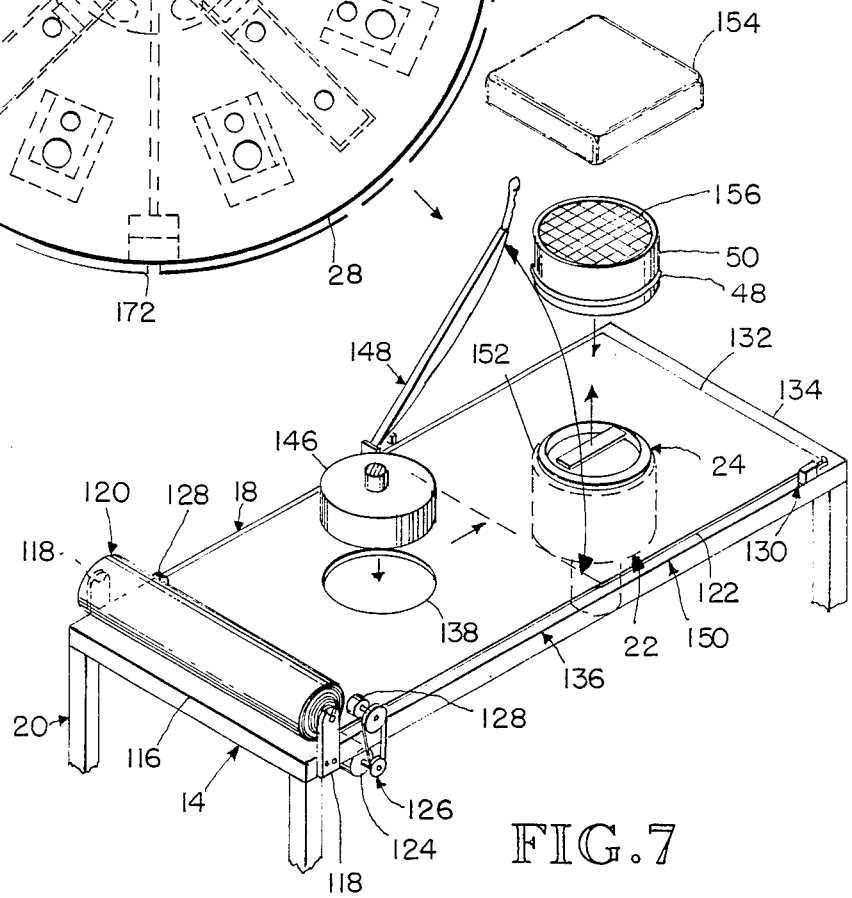
FIG. 7 is a perspective view of a preferred embodiment of a machine used in the manufacture of the lead base metal roof vent, illustrating a bench height structure having a base frame and an elongated surface structure with two spaced holes, a starting end having a mounting to receive a roll of lead, a power unit to unroll the lead, an adjacent cutting area with one of the two spaced holes, a lead hole cutting assembly mounted over this cutting area, a lead cross cut cutting assembly positioned on the bench height structure at the end of the cutting area, the adjacent lead forming area of the elongated surface structure, not showing the hold down assembly positioned on the bench height structure over the lead forming area operated to hold a modified metal roof vent down on the lead placed on the elongated surface structure, but showing the cylindrical body of the vent, and the removed weather cover of the vent, while centered about the other of the two spaced holes in the lead forming area, the lead forming assembly positioned on the bench height structure under the lead forming area, to be operated to move portions of the lead, about the center hole, up into the cylindrical body and beyond the inside entry circular recess, and then to circumferentially move these raised portions of the lead to create an inside entry circular recess of the lead, which complementary fits the inside entry circular recess of the cylindrical body of the modified metal roof vent, thereby creating a lead base metal roof vent, and then stop mechanism to stop the advancing sheet of lead at the end edge of the elongated surface structure of this machine.
Figure 8:
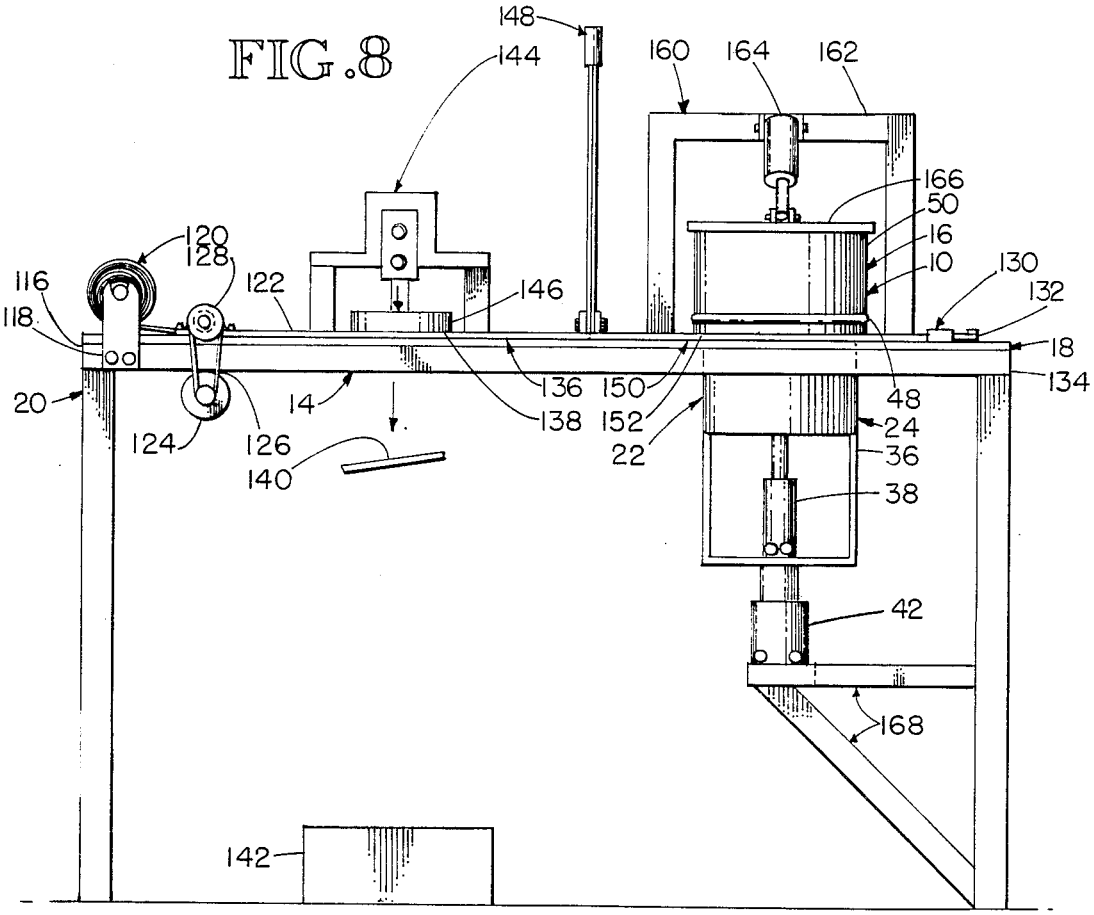
FIG. 8 is a front elevation of the preferred embodiment of the machine, as illustrated in FIG. 7, with some portions removed for illustration purposes, and showing the hold down assembly.
Figure 9:
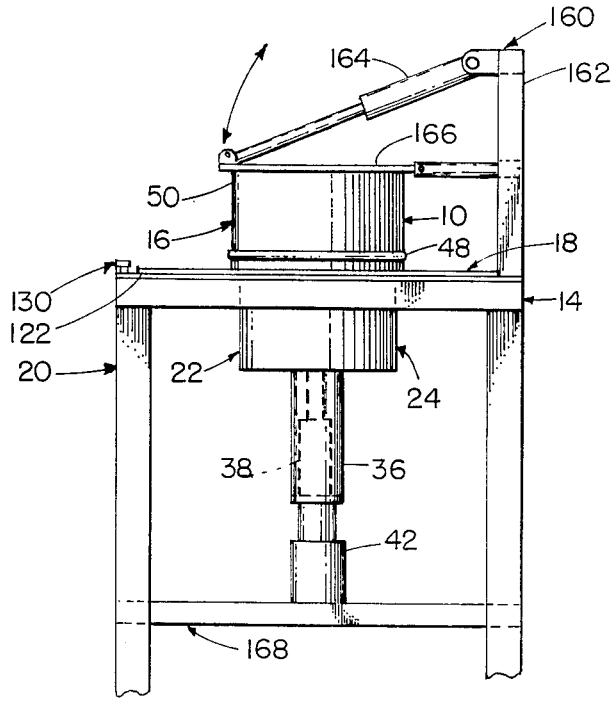
FIG. 9 is a side elevation of the preferred embodiment of the machine, as illustrated in FIG. 7, with some portions removed for illustrative purposes, showing only the hold down assembly, the cylindrical body of the vent and the lead forming assembly mounted on the bench height structure, indicating the lower supporting frame, the subassembly of the lead forming assembly, having in turn a first or lower lifting mechanism, an upper frame, the second lifting mechanism, the hollow crown edge forming dome die, the lead, the cylindrical body of the modified metal roof vent, and the hold down assembly.

In FIGS. 7, 8, and 9, the lead forming assembly 22 is illustrated positioned among other components which together comprise the preferred embodiment of a machine 14, operated to produce the roof vent 10 with lead base 12. As shown in FIG. 7, a bench height structure 20 has an elongated surface structure 18. At the starting end 116 of this surface structure 18, roll supports 118 are provided to rotatably hold a roll 120 of lead 122. Adjacent to the roll supports 118 is a driving motor 124, pulley system 126, and drive rollers 128, to unroll the lead 122 and to move the lead across the elongated surface structure 18, until the sensor subassembly 130 operates, when the leading edge 132 of the lead 122 essentially reaches the finishing end 134 of the bench height structure 20.

There is a lead cutting area 136 of the elongated surface structure 18, adjacent the location of the roll of lead 120. In the center of this lead cutting area 136 is a clearance hole 138 through which cut circular portions 140 of lead 122 fall clear, generally landing in a collecting container 142. The cut circular portions 140, are cut away by using the lead hole cutting assembly 144, which is positioned on the bench height structure 20, having a hole cutter 146 thereof, which is aligned with the hole 138.

At the end of this lead cutting area 136, a pivotal cross cut mechanism 148 is mounted on the bench height structure 20, and used to cut off a length of lead 122 to the specified size of a lead base 12 of a roof vent 10. This cutting operation may be powered by a means not shown.

Next to this pivotal cross cut mechanism 148, and next to the lead cutting area 136, is the lead forming area 150. In the center of this lead forming area 150, is another clearance hole 152, through which passes the hollow crown edge forming dome die 24. Preferably, as shown in FIG. 7, a modified metal roof vent 16, without a base of any kind, has the weather cover 154 temporarily removed, showing a screen 156 thereof, and subsequently, the cylindrical body 50 of this vent 16, is lowered over the other clearance hole 152.

An overhead clamp assembly 160, having a frame 162, secured to the bench height structure 20, supports a compressing mechanism 164 thereof having a pressing head 166. Upon operation of this overhead clamp assembly 160, the cylindrical body 50 of the vent 16 is held in place during the operations of the lead forming assembly 22, as shown in FIGS. 8 and 9. During these lead forming operations, as illustrated in FIGS. 2 and 3, circular portions 44 of a lead base 12 are first moved upwardly, and then moved radially to complete their connection to the modified metal roof vent 16, thereby making the roof vent 10 with the lead base 12.

In FIGS. 8 and 9, the lower frame 168 is shown secured to the bench height structure 20, to support the first lifting mechanism 42. This first lifting mechanism 42, in turn movably supports the upper frame 36, which is connected to the hollow crown edge forming dome die 24. Upon operation of the first lifting mechanism 42, the hollows crown edge forming dome die 24 is raised, thereby moving the circular portions of lead 44 up into the interior of the cylindrical body 50 of the modified metal roof vent 16, above the location of the inside entry circular recess 48.

The second lifting mechanism 38 is secured to the upper frame 36. During the operation thereof, this second lifting mechanism 38 raises the centered upright shaft 60, thereby operating the linkage subassembly 40 and the radial expanding forming die subassembly 26, and the radially movable die segments then form the inside entry circular recess 46 of the lead base 12. This recess 46 complementary fits the inside entry circular recess 48 of the cylindrical body 50 of the modified metal roof vent 16, completing their securement one to the other. As shown in FIGS. 2 and 3, a sealant 52 is positioned between them.

After these lead forming operations are completed, the overhead clamping assembly 160 is released and roof vent 10 with the lead base 12 is withdrawn.

To prepare for the manufacture of the next roof vent 10 with the lead base 12, the lead 122 is unrolled some more and portions of lead 122 are moved across the elongated surface structure 18 for their cutting, forming, and fitting with the modified metal roof vents 16 to also become the roof vents 10 each with a lead base 12, which are very long lasting when installed on any roof and especially on tiled roofs.

Preferably the mechanisms will be hydraulic, having the hydraulic lines 170, as shown in FIG. 1.

In the forming of the lead 122, in respect to the circular lead portions 44, which become portions of the lead base 12 of the roof vent 10, upon the radial expansion of the radially movable die segments 28, during operation of the radial expanding forming die subassembly 26, the overall expanded circumference of these radially movable die segments 28 is not continuous. There are gaps 172, which results in a non continuous formation of the inside entry circular recess 46 of the lead base 12. Preferably therefore, after the first radial expansion of the radial expanding forming die subassembly 26, the cylindrical body 50 of the almost completely formed roof vent 10 with the lead base 12 is rotated sufficiently, and another operation follows of the radial expanding forming die subassembly 26. In this way, the radially movable die segments 28 fully form a continuous inside entry circular 46 of the lead 12, which fully complementary fits the inside entry circular recess of the cylindrical body 50 of the roof vent 10 with the lead base 12.

THE METHOD OF MAKING THE ROOF VENT WITH THE LEAD BASE

The method of making this roof vent 10 with lead base 12, concerns the steps of:

Selecting a modified metal roof vent. There are several complete roof vents already produced, which, however, do not have a lead base. Many of these, if modified, could receive a lead base. They should have a cylindrical body 50, which also has an inside entry circular recess structure 48. If not, a first step of the method, would be to form such a recess structure 48;

Removing a selected length of a sheet of lead from a roll of lead. Preferably, the convenient form of obtaining lead is by the purchase of a roll of lead. However, if lead were to be available in properly sized pieces for respective sized bases of respective sized vents, then this step of removing of lead lengths from a roll would be bypassed;

Cutting of a selected length of lead. If precut base sizes were available, this method step would not be required;

Cutting a circular hole in the center of the cut off selected length of lead of a diameter less than the vent diameter size. By following this step the circular lead portions 44 of the base 12 are determined to be adequate in size for their forming by the lead forming assembly 22. The term cutting includes stamping by a cutting die as well as using rotary cutters;

Placing a selected modified metal roof vent 16 over a circular hole in a selected length of lead 112. Such placement assumes this vent 16 will stay in place. However, as shown and illustrated, an overhead clamp assembly 160 is part of the machine 14;

Applying a uniform upwardly directed force to the lead 122 around the circular hole in the lead, which initially extends inwardly beyond the interior diameter of the open bottom of the selected modified metal roof vent 16, thereby moving these lead portions 44 up through the open bottom about the inside entry circular recess structure 48 positioned above this open bottom. It is preferred to apply this uniform upwardly directed force throughout the entire circumference at the same time, rather than apply the force progressively around the circumference;

Applying a uniform outwardly radially directed force to the lead 122, which is then opposite the inside entry circular recess structure 48 of the cylindrical body 50, thereby moving lead portions 46 into a complementary fit with this inside entry circular recess structure 48. This application of force is applied substantially uniformly at the same time, with the exception of where gaps 172 occur between the radially movable die segments 28. This applying of force could be progressively undertaken. Preferably, it is not. However, preferably there is a second application of force after the cylindrical body 50 with the lead base 12 attached is slightly rotated. By following this procedure, the inside entry circular recess 46 of the lead base 12 is formed continuously throughout the full circumference, insuring a very strong connection and, with the sealant, a very weatherproof connection, of the lead base 12 to the roof vent 10.

If any portions of this roof vent 10, which are not made of lead, need protection from the weather, a final step would be to so protect them by a coating of a suitable substance. Generally the modified metal roof vents 16 which are selected have been so protected.

I claim:

1. A machine for manufacturing a lead base metal roof vent which is installed during and after roofing a dwelling with overlapping tiles, comprising:

(a) a bench height structure having a base frame and an elongated surface structure with two spaced holes, in turn having a starting end, to receive a roll of lead, an adjacent lead cutting area with one of the two spaced holes, and an adjacent lead forming area with the other of the two spaced holes, to receive a modified metal roof vent, selected from several available types, however, not having a base, but having a cylindrical body, having in turn an open top end and an open bottom end, an inside entry circular recess structure positioned above this open bottom, and a weather cover secured at a spaced distance above the open top end;

(b) a lead roll supporting assembly secured to the bench height structure at the starting end of the elongated surface to rotatably support a roll of lead;

(c) a lead hole cutting assembly positioned on the bench height structure over the lead cutting area to cut holes of various specified diameters;

(d) a lead cross cut cutting assembly positioned on the bench height structure at the end of the cutting area to create specified lengths of the lead, then with center holes;

(e) a hole down assembly positioned on the bench height structure over the lead forming area, to be operated to hold a modified metal roof vent down on the lead placed on the elongated surface structure, while centered about the other of the two spaced holes in the lead forming area; and (f) a lead forming assembly positioned on the bench height structure under the lead forming area, in line with the other of the two spaced holes in the lead forming area, to be operated to move portions of the lead, about the center hole, up into the cylindrical body beyond the inside entry circular recess, and then to circumferentially move these raised portions of the lead to create an inside entry circular recess of the lead, which complementary fits the inside entry circular recess of the cylindrical body of the modified metal roof vent, thereby creating a lead base metal roof vent.

2. A machine for manufacturing a lead base metal roof vent, as claimed in claim 1, comprising, in addition, a powered lead moving assembly positioned on the bench height structure at the starting end of the elongated surface to move the lead leaving the lead roll supporting assembly along the elongated surface structure.

3. A machine for manufacturing a lead base metal roof vent, as claimed in claim 2, comprising, in addition, a sensing switch to determine when the moving lead, at the leading edge thereof, reaches the end of the elongated surface, and then to stop the powered lead moving assembly, during forming of the lead to create a lead base metal roof vent.

4. A machine for manufacturing a lead base metal roof vent, as claimed in claim 1, wherein the lead forming assembly, in turn, comprises:

(a) a lower supporting frame, positioned, at least, on the bench height structure to support a subassembly of the lead forming assembly, which moves portions of the lead about the center hole, up into the cylindrical body beyond the inside entry circular recess of the modified metal roof vent;

(b) a subassembly of the lead forming assembly secured to the lower supporting frame, comprising:

a lifting mechanism to create a lifting force secured to the lower supporting frame;

an upper frame connected to the lifting mechanism to receive the lifting force;

a hollow crown edge forming dome die secured to the upper frame at the top thereof, whereby when the lifting mechanism creates a lifting force, the hollow crown edge forming dome die moves portions of the lead, about the center hole, up into the cylindrical body beyond the inside entry circular recess of the modified metal roof vent;

a radial expanding forming die subassembly, secured within the hollow crown edge forming dome die, having:

radially movable die segments;

a linkage subassembly to receive a second lifting force and to convert such second lifting force into radial moving forces to move the radially movable die segments; and a second lifting mechanism to create the second lifting force secured to the upper frame just below the top thereof, and movably projecting up to the hollow crown edge forming dome die for connection with the linkage subassembly, whereby when the second lifting mechanism creates a lifting force, the radially movable die segments, via the operation of the linkage subassembly, move the radially movable die segments to form the inside entry circular recess structure of the upturned lead into a complementary fit with the inside entry circular recess structure of the cylindrical body of the modified metal roof vent, thereby creating a lead base metal roof vent.

5. A machine for manufacturing a lead base metal roof vent, as claimed in claim 4, wherein the linkage subassembly, in turn comprises:

(a) a centered upright shaft for connection to the second lifting mechanism and extending upwardly through the hollow crown edge forming dome die, having a bolt-like head, which remains above a guiding central hole structure of the hollow crown edge forming dome die, and threads extending from a central portion thereof down to the end thereof;

(b) an upper circular guide plate subassembly having a guide plate with a hole to receive the centered upright shaft, having circumferentially spaced holes in the guide plate to receive fasteners, having fasteners which secure this guide plate to the hollow crown edge forming dome die, having four sets of radially spaced holes in the guide plate, arranged ninety degrees apart, to receive fasteners, having fasteners which secure four radially extending and depending guide bars having these guide bars for such positioning, and four circumferentially spaced holes in the guide plate to receive fasteners, having fasteners which secure four depending spacer bars, and having four depending spacer bars for such positioning;

(c) the said radially movable die segments, each being formed with circumferentially spaced holes to receive fasteners, having fasteners which secure depending push rod receiving socket bars, having push rod receiving socket bars for such positioning, which each have half spherical receiving holes, and having spaced radially extending receiving slots to slidably receive the depending guide bars of the upper circular guide plate assembly, and having circumferentially cut out portions to clear the depending spacer bars;

(d) a lower circular guide plate with a hole to receive the centered upright shaft, having radially spaced slots providing clearance for the respective depending push rod receiving socket bars and respective depending push rods, and having respective circumferential slots to receive respective depending spacer bars;

(e) a coiled spring moved up around the centered upright shaft into contact with the lower circular guide plate;

(f) a non threaded hub moved up around the centered upright shaft into contact with the coiled spring, having an integral surrounding upwardly facing downwardly sloping surface structure, in turn having spaced half spherical receiving holes;

(g) a tension nut threaded up around the centered upright shaft to contact the non threaded hub;

(h) a lock nut threaded up and around the centered upright shaft to contact the tension nut;

(i) push rods having domed ends, one fixed, the other adjustable, having threads at one end to adjust the axial positioning of the threaded adjustable dome end, and these push rods are tiltably mounted on a bias between the non threaded hub below and the push rod receiving socket bars above, using the respective half spherical receiving holes of both these hubs and these socket bars; and (j) coiled return spring subassemblies, each one having a depending spring anchor secured to the bottom of the lower circular guide plate, and a respective coiled return spring secured between a respective depending spring anchor and a respective depending push rod receiving socket bar.

6. A machine for manufacturing a lead base metal roof vent, as claimed in claim 5, wherein the linkage assembly includes a stroke adjustment subassembly, comprising a cross abutment member with holes at each end, spacer cylinders with centered holes, and threaded bolts for securing the cross abutment member a selected distance above the upper circular guide plate assembly, using the selected spacer cylinders surrounding the threaded bolts, which in turn, are threaded into the top of the hollow crown edge forming dome die, whereby the second lifting force is selectably controlled to in turn control the scope of the outwardly radial movement of the radially die segments.

* * * * *